US006120728A

United States Patent [19]

Hinzmann et al.

[11] Patent Number: 6,120,728

[45] **Date of Patent: *Sep. 19, 2000**

[54] METHOD OF MAKING A COMPONENT USING A PHASED SPLIT DIE

[75] Inventors: Gerd Hinzmann, Oakville; Mark Haiko, Burlington; Keith Bukley-Golder, Oakville; Robert Round; Alan Wilson, both of Burlington; Frank Ma, Mississauga, all of Canada

[73] Assignee: Stackpole Limited, Oakville

[ * ] Notice: This patent is subject to a terminal disclaimer.

[21] Appl. No.: 08/964,829

[22] Filed: Nov. 5, 1997

Related U.S. Application Data

[63] Continuation of application No. 08/495,476, Sep. 11, 1995, Pat. No. 5,698,149, and a continuation of application No. PCT/CA93/00506, Nov. 24, 1993.

[51] Int. Cl.[7] ..... B22F 5/10

[52] U.S. Cl. ..... 419/66

[58] Field of Search ..... 264/109, 120, 264/294, 325; 425/78, 344, 346, 347, 348 S, 352, 353, 354, 355, 443; 419/66

[56] References Cited

U.S. PATENT DOCUMENTS

| | | |
|---|---|---|
| 2,561,735 | 7/1951 | Haller . |
| 3,020,589 | 2/1962 | Maritano . |
| 3,394,432 | 7/1968 | Laurent . |
| 3,694,127 | 9/1972 | Takahashi et al. . |
| 3,752,622 | 8/1973 | Viadana . |
| 3,773,446 | 11/1973 | Borrini . |
| 3,842,646 | 10/1974 | Kuhn . |
| 3,891,367 | 6/1975 | Signora . |
| 3,909,167 | 9/1975 | Signora . |
| 4,008,021 | 2/1977 | Fedrigo et al. . |
| 4,043,385 | 8/1977 | Petrenchik . |
| 4,047,864 | 9/1977 | De Santis . |
| 4,053,267 | 10/1977 | De Santis . |
| 4,061,452 | 12/1977 | De Santis . |
| 4,061,453 | 12/1977 | De Santis . |
| 4,087,221 | 5/1978 | Munson et al. . |
| 4,153,399 | 5/1979 | De Santis . |
| 4,270,890 | 6/1981 | Ottl . |
| 4,401,614 | 8/1983 | De Santis . |
| 4,482,307 | 11/1984 | Schaidl et al. . |
| 4,573,895 | 3/1986 | De Santis . |
| 4,666,389 | 5/1987 | Relis et al. . |
| 4,853,180 | 8/1989 | Howard . |
| 4,923,382 | 5/1990 | Klein . |
| 5,024,811 | 6/1991 | Hinzmann et al. . |
| 5,043,111 | 8/1991 | Hinzmann et al. . |
| 5,043,123 | 8/1991 | Gormanns et al. . |
| 5,049,054 | 9/1991 | Schaidl et al. . |
| 5,156,854 | 10/1992 | Yamada . |
| 5,238,375 | 8/1993 | Hirai . |
| 5,259,744 | 11/1993 | Take . |
| 5,326,242 | 7/1994 | Katagiri et al. . |
| 5,366,363 | 11/1994 | Good et al. . |
| 5,378,416 | 1/1995 | Kishi et al. ..... 425/352 |
| 5,401,153 | 3/1995 | Katagiri et al. . |
| 5,478,225 | 12/1995 | Takeuchi et al. . |
| 5,498,147 | 3/1996 | Katagiri et al. . |

OTHER PUBLICATIONS

SAE Technical Paper Series 960278, Nagata and Sugimoto, Feb. 26–29, 1996 "The Development of P/M Complicated Shape Helical Gears".

*Primary Examiner*—Jan H. Silbaugh
*Assistant Examiner*—Kenneth M. Jones
*Attorney, Agent, or Firm*—John R. S. Orange

[57] ABSTRACT

This invention relates to a device to compact parts with an undercut out of powder metal, including a pair of dies linearly moveable relative to one another and then phased, and an associated linearly displaceable pair of punches to produce said parts with said undercut.

8 Claims, 5 Drawing Sheets

METHOD OF MAKING A COMPONENT USING A PHASED SPLIT DIE

This application is a continuation of copending application application Ser. No. 08/495,476 filed on Sep. 11, 1995, now U.S. Pat. No. 5,698,149, and International Application PCT/CA93/00506 filed on Nov. 24, 1993 and which designated the U.S.

FIELD OF INVENTION

This invention relates to dies and particularly split dies for producing compacted parts out of powder material having an undercut, and more specifically relates to a device to compact parts out of powder material which includes a pair of dies linearly moveable relative to one another and then phased, and an associated linearly displaceable pair of punches for producing parts which are phased or have an undercut.

BACKGROUND OF THE INVENTION

Devices to compact parts out of powder material for sintering are well known to those persons skilled in the art. In some cases, the compacted part has an undercut which prevents removal of the part or blank from the dies by linear or axial displacement.

Tool sets with split dies are known in powder material compaction to press parts into shapes that have an undercut in the compacting direction.

For example, U.S. Pat. No. 3,773,446 teaches a device for moulding parts to be sintered by compressing powdered material held between a fixed die and moveable die. A pair of punches extending through the dies compresses the powder material. A pressure plate operated by the punch extending through the moveable die engages the moveable die and is also locked to the fixed die during the compression to produce a part having an undercut.

U.S. Pat. No. 3,752,622 teaches a device for moulding blanks with undercut parts to be sintered by compaction of powder material.

The prior art teaches that both parts of the die are tied together while a feed box moves across the top of the dies for filling the cavity with powdered material. After compaction the upper part of the die moves away together with the top punch to eject the part.

One of the disadvantages of the known systems as referred to above relates to the fact that the upper part of the die has to be tied mechanically to the lower part of the die and the upper punch in an alternating mode, thus making a complicated tool rig necessary.

Moreover, gearsets and camsets, for example, are characterized by two levels of the same shape but phased to each other to comprise an undercut in the compacting direction. Such parts may be manufactured in known methods as referred to above with the disadvantages noted therein.

Another disadvantage of the prior art is that the undercut can only be indirectly filled thereby creating a section of lower density in the compacted part.

It is therefore an object of this invention to provide a device that is simpler to construct and more efficient to operate than heretofore known by the prior art.

It is another object of this invention to provide a tool system with a split die where both parts of the die remain tied to one part of the rig during the entire cycle.

It is a further object of this invention to provide a device and method to produce compact phased parts such as gears, cams and the like with less complicated tooling and more efficient fill of the undercut than presently available.

In a first aspect of the invention there is provided a tool set for a powder molding machine having a pair of die sets each having a die and a punch moveable relative thereto to define respective chambers, the die sets co-operable to place the chambers in communication and thereby to define a mold cavity, the punches being movable relative to one another in a direction parallel to a common axis to reduce the volume of the mold cavity and to compress powder therein, the dies being movable relative to one another in a plane normal to the common axis, independently of movement along the common axis, to displace the chambers relative to one another and to define a phased component in the mold cavity, and the dies being separable in the direction of the common axis to permit a molded component to be removed therefrom.

In one aspect of the invention the dies are movable in linear translation, one relative to the other, in the plane normal to said common axis. In another aspect of the invention the dies are movable in rotation, one relative to the other, in said plane normal to the common axis.

In another aspect of the invention, the tool set is additionally movable to filling, transfer, lateral displacement and withdrawal positions and each said punch is at least partially engaged with each of said dies of said respective die sets in each of said filling, transfer, lateral displacement and withdrawal positions.

In still another aspect of the invention there is provided a tool set for mounting in a powder compacting press, the press having an axis of reciprocation, the tool set comprising a first die and punch set for mounting with the press, including a first die and a first punch movable within the first die to form a first chamber for receiving a charge of powder; a second die and punch set for mounting with the press, the second die and punch set co-operable with the first die and punch set and including a second die and a second punch movable within the second die for forming a second chamber therewithin; the second die movable parallel to the axis relative to the first die to meet the first die at an interface; and with the first and second dies in contact at the interface and with the first and second chambers in communication to define a closed mold cavity for containing the charge of powder, the second die being movable relative to the first die to a transversely displaced position.

Another aspect of the invention encompasses a press assembly for producing compacted powder metal parts, that press assembly comprising a powder press having an axis of reciprocation and a tool set for mounting in that press, that tool set including a first die set and a second die set, the first die set having a first die and a first punch movable in sliding engagement with, and relative to, the first die for forming a first chamber, the second die set having a second die and a second punch movable in sliding engagement with, and relative to, the second die for forming a second chamber, the die sets co-operable to place the chambers in communication and thereby to define a mold cavity, the punches being movable relative to one another in a direction parallel to the axis to reduce the volume of the mold cavity and to compress powder therein, the dies being movable relative to one another in a plane normal to the axis independently of movement along the axis to displace the chambers relative to one another and to define a phased component in the mold cavity, and the dies being separable in the direction of the common axis to permit a molded component to be removed therefrom.

One aspect of the invention is a method for making compacted powder parts with a tool set for mounting in a press having an axis of reciprocation, the tool set including a first die and punch set mountable in the press and a co-operating second die and punch set mountable in the press, the first die and punch set including a first die and a first punch movable therewithin to form a first chamber, the second die and punch set including a second die and a second punch movable therewithin to form a second chamber, that method comprising the sequential steps of a) establishing the tool set in a position in which the first chamber and the second chamber are in communication to form a closed mold cavity, with a charge of powder captured therein; b) displacing the second die relative to the first die while maintaining the first and second chambers in closed communication; c) compacting the powder to form a compacted powder part; and d) ejecting the compacted powder part from the tool set, in one embodiment of the invention the step of displacing includes linearly translating the second die relative to the first die. In another embodiment of the invention the step of displacing includes rotating the second die relative to the first die about an axis parallel to the axis of reciprocation. In yet another embodiment of this aspect of the invention step (a) includes a(i) filling the first chamber with the charge of powder; and a(ii) transferring a portion of the charge of powder from the first chamber to the second chamber.

DRAWINGS OF THE INVENTION

These and other objects and features of the invention shall now be described in relation to the following drawings.

Figure 4B:
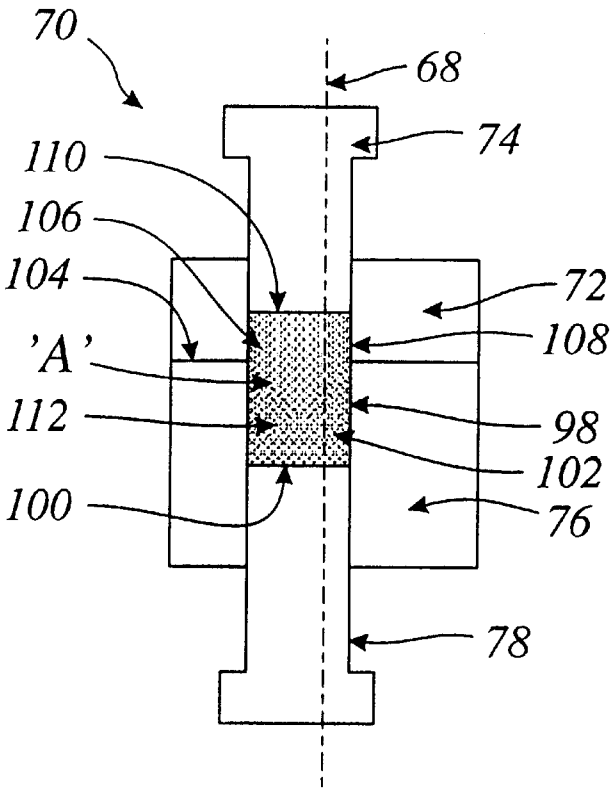
Figure 4A:
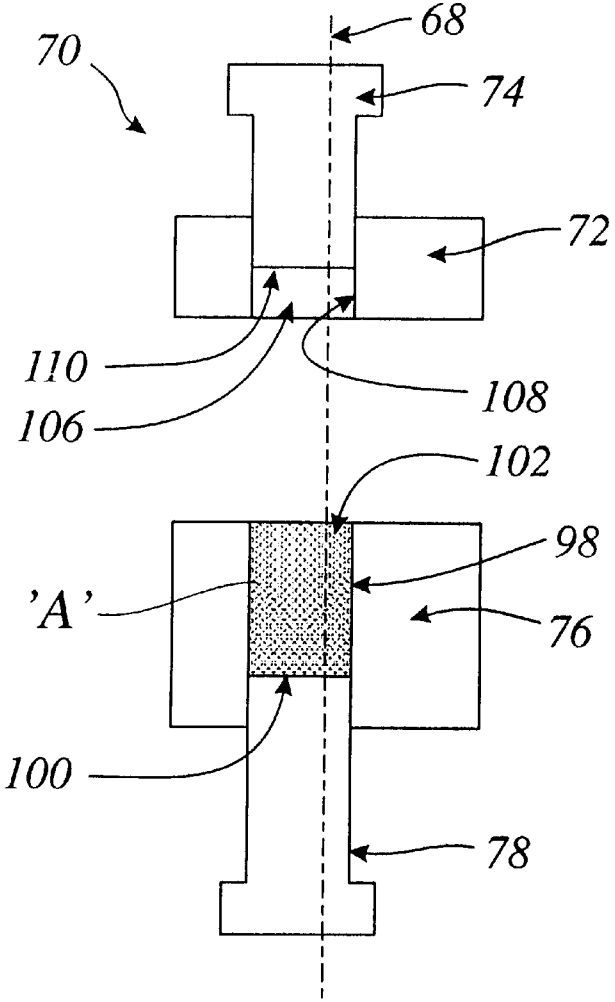

FIG. 4*a* shows a tool set in a position for receiving a charge of powder.

FIG. 4*b* shows the tool set of FIG. 4*a* in a closed, transfer position.

Figure 4E:
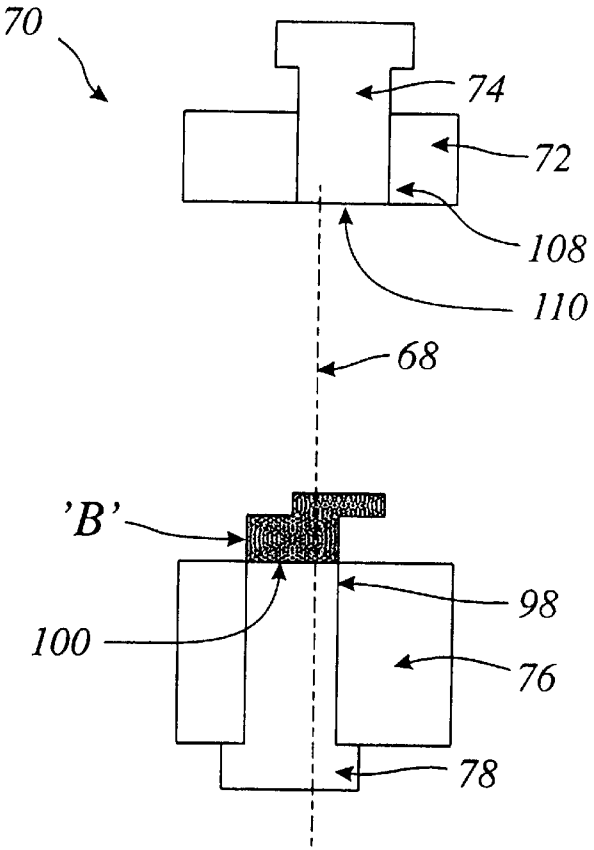
Figure 4D:
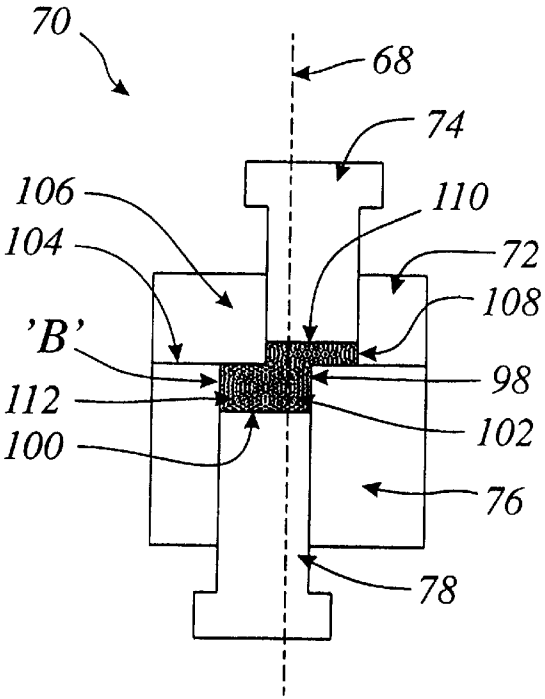
Figure 4C:
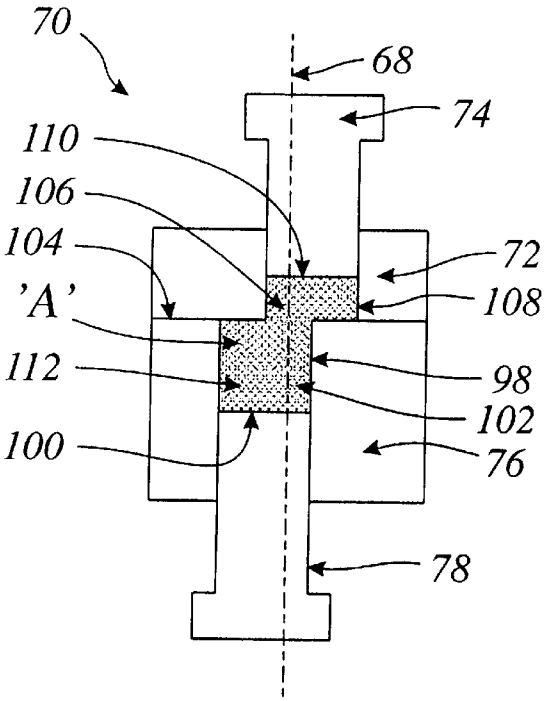

FIG. 4*c* shows the tool set of FIG. 4*a* in a phased position.

FIG. 4*d* shows the tools set of FIG. 4*a* in a compacted position

FIG. 4*e* shows the tool set of FIG. 4*a* in a withdrawal position for ejecting a compact.

Figure 5:
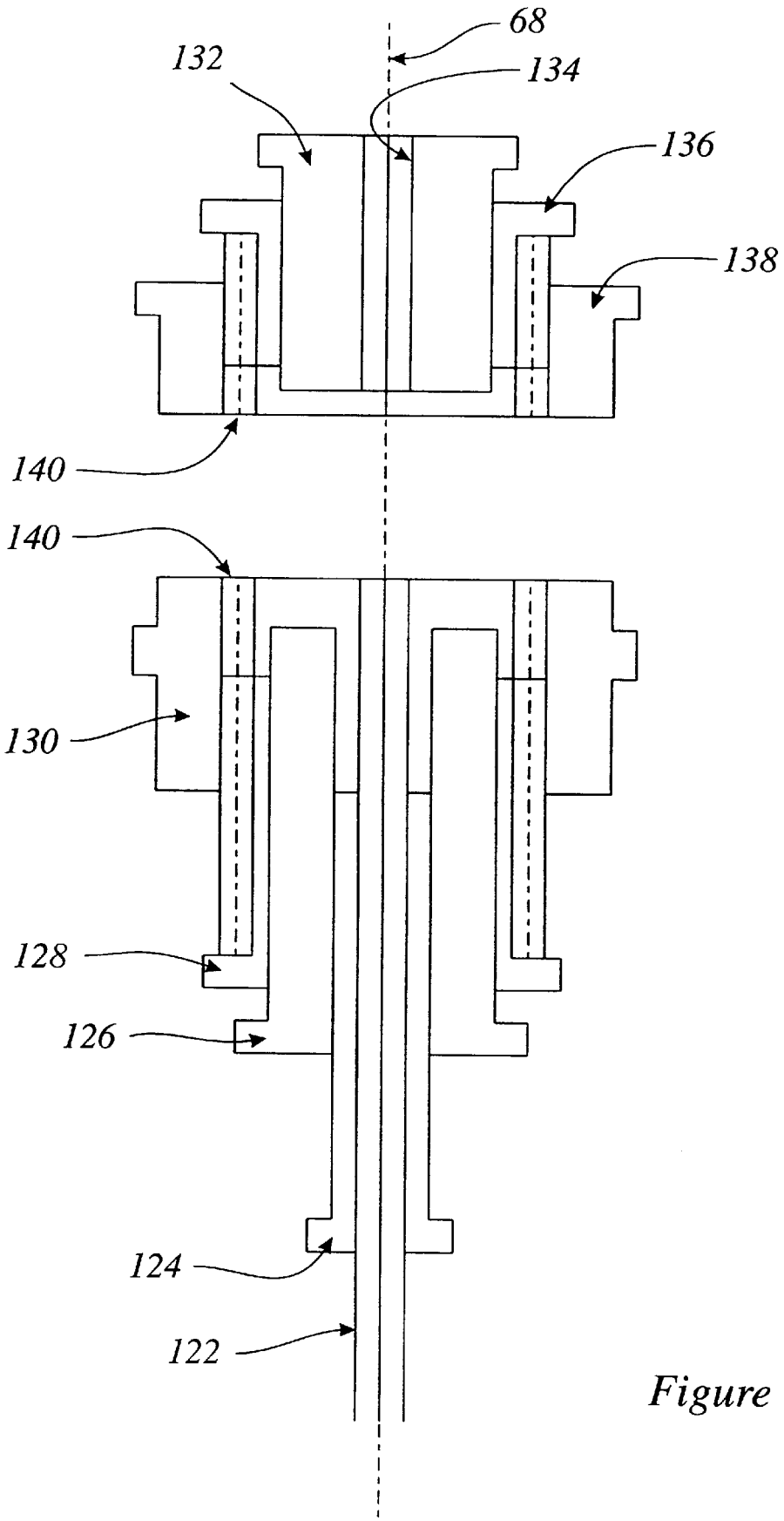

FIG. 5 is a schematic view of a second embodiment of tool set employing multiple punches.

Figure 6:
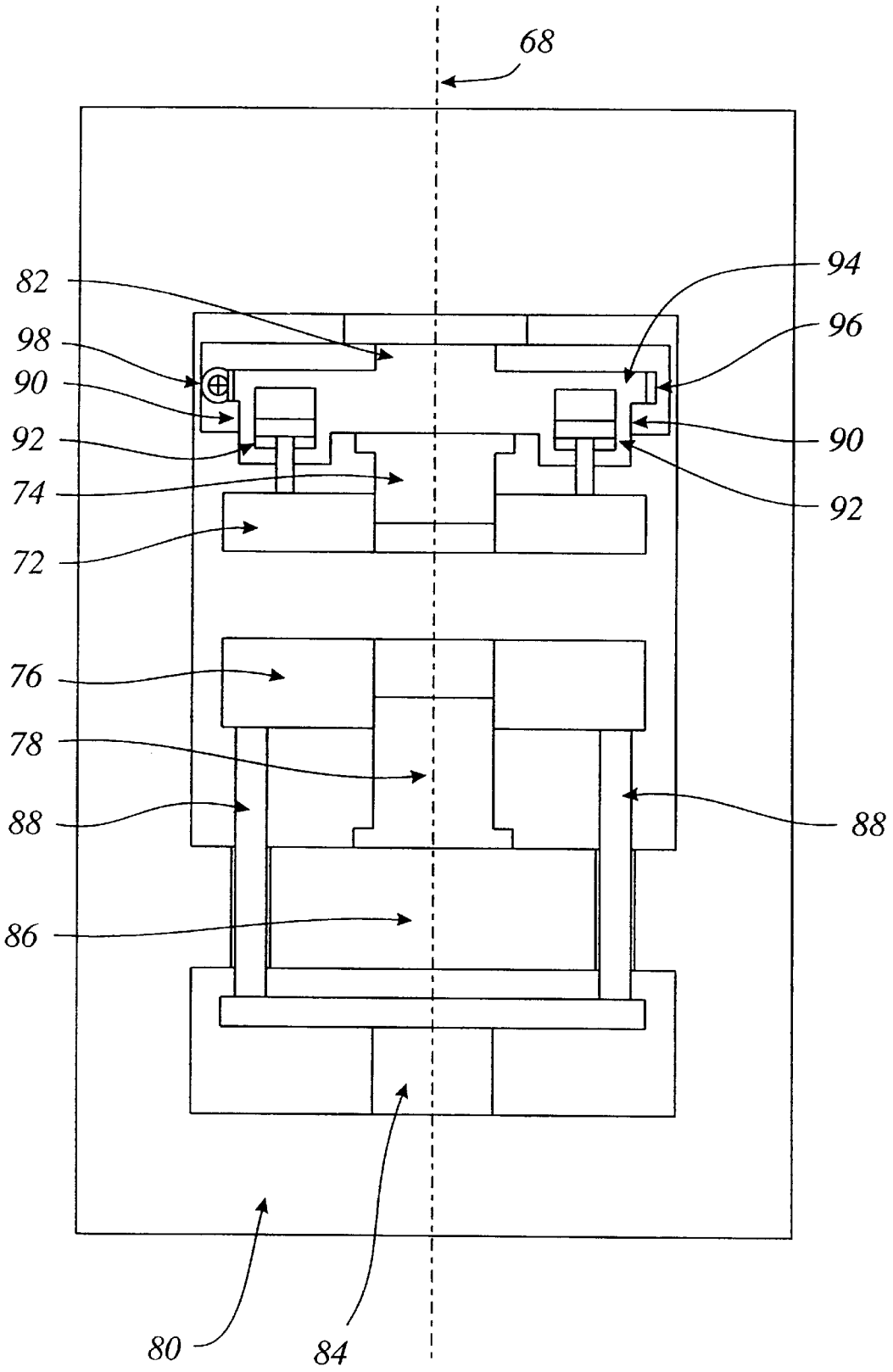

FIG. 6 is an elevation of a press in which the tool set of FIGS. 4*a* through 4*e* has been mounted.

Like parts are given like numbers throughout the detailed description of the preferred embodiments of the invention which follows.

DESCRIPTION OF THE INVENTION

Figure 2:
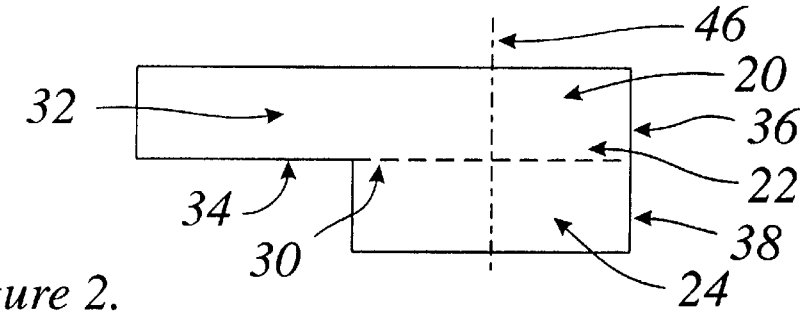
FIG. 2 is an elevation of the phased part of FIG. 1 in the direction of arrows '2—'2.
Figure 1:
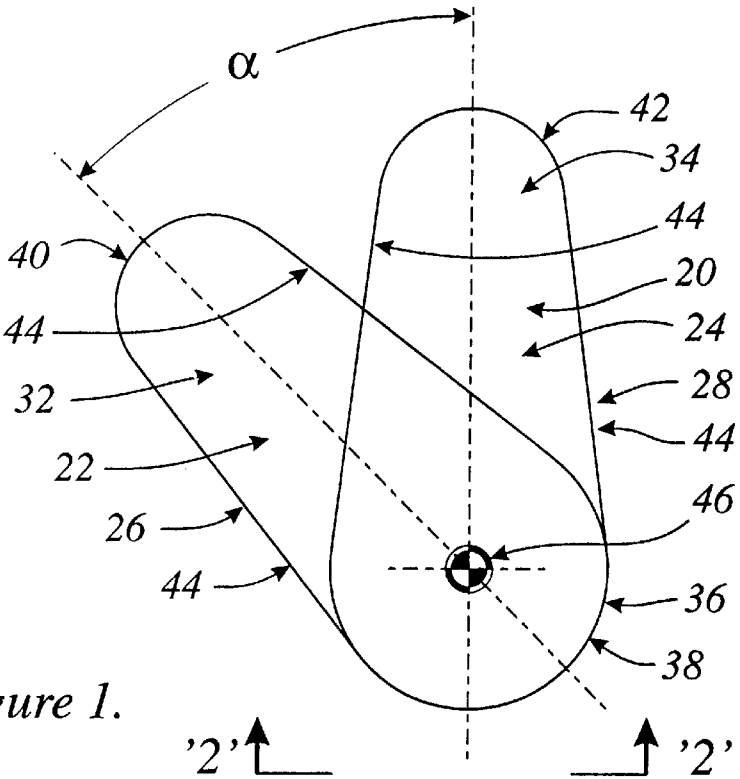
FIG. 1 is a top view of a rotationally phased part such as a cam of a design suitable for fabrication with the apparatus and method of the present invention.

An undercut part is shown generally in FIGS. 1 and 2 as 20. It has a first, or upper portion 22 and a second, or lower portion 24. Upper portion 22 has a first, or upper profile 26, and lower portion 24 has a lower profile 28. Upper portion 22 and lower portion 24 meet at an interface 30. An overhang 32 of upper portion 22 extends beyond the perimeter of lower portion 24 defined by lower profile 28. Similarly a toe 34 of lower portion 24 extends beyond the perimeter defined by upper profile 26. The lower face of overhang 32 lying along interface 30 defines an undercut 34.

In part 20 illustrated in FIGS. 1 and 2, upper profile 26 and lower profile 28 are identical, differing only in angular orientation. As shown they represent adjoining cams of a cam set, each having a major arc 36 and 38, respectively, and a minor arc, 40 and 42, respectively, joined by tangential surfaces 44. As shown, major arcs 36 and 38 share a common radius of curvature about an axis 46, which, for convenience shall arbitrarily be referred to as a longitudinal, or vertical axis. Overhang 32 corresponds to that portion of upper profile 26 that extends beyond lower profile 28 when upper profile 26 has been displaced relative to lower profile 28 by rotation about, and in a plane perpendicular to, axis 46 through a phase angle $\alpha$, as indicated in FIG. 2. In such a position upper portion 22 is rotationally phased relative to lower portion 24.

In a part 50 illustrated in FIG. 3, once again there is provided upper portion 22 and lower portion 24 having profiles 26 and 28 respectively, and overhang 54 and a toe 56. In this case profiles 26 and 28 share a common major axis 58 and have respective minor axes 60 and 62. Axes 58, 60, and 62 are perpendicular to axis 46. Axes 60, and 62 are offset laterally, that is to say, transversely to axis 46, from each other by linear translation through a translational phase displacement indicated as $\delta$. In the position shown in FIG. 3, upper portion 22 is translationally phased relative to lower portion 24.

Figure 3:
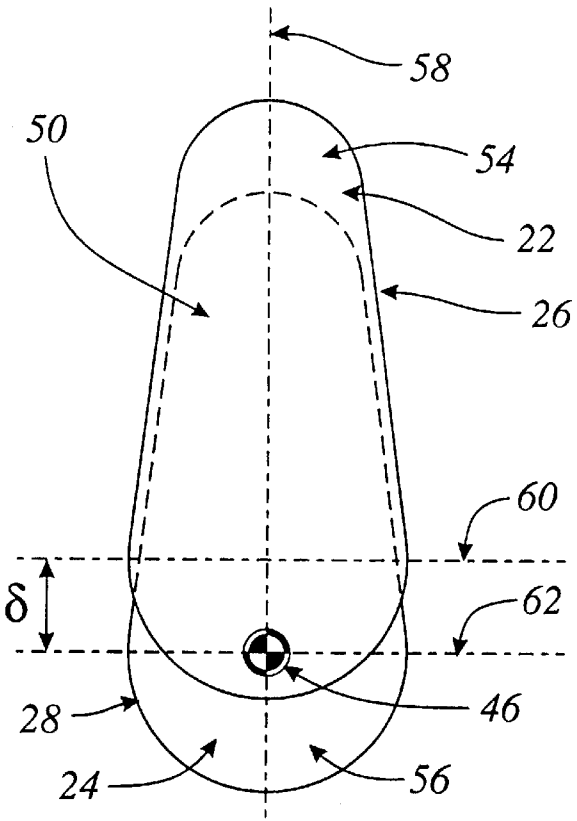
FIG. 3 is a top view similar to FIG. 1 of an alternative embodiment of a phased part.

Although a cam set, in the nature of part 20 or part 50, is illustrated in FIGS. 1, 2 and 3, the invention as described herein can be used to manufacture gear sets or any other part which is phased or has an undercut in the compacting direction, that is, the direction parallel to axis 46. A tool set 70 for making phased parts, such as part 20 or part 50, is shown, in simplified form, in FIGS. 4*a* through 4*e*. An axis 68, which is arbitrarily denoted a longitudinal, or vertical axis, is defined to facilitate explanation. Tool set 70 includes an upper die set comprising an upper die 72 and a mating upper punch 74. The punch 74 can slide within die 72 so can move parallel to axis 68. Tool set 70 also includes a lower die set including a lower die 76 and its corresponding mating lower punch 78 which is slidably mounted for movement parallel to axis 68. Tool set 70 may be mounted in a press 80, as shown in FIG. 6, of a type well known to those skilled in the art, which includes a head having an upper ram 82, and a base having lower ram 84 and press table 86 which is fixed relative to the frame of press 80.

As shown in FIG. 6, lower punch 78 is rigidly mounted to press table 86. Lower die 76 is mounted about lower punch 78 and is rigidly mounted to lower ram 84 on supports 88 such that motion of lower ram 84 relative to press table 86 parallel to axis 72 will result in corresponding relative motion of lower die 76 to lower punch 78. Upper punch 74 is rigidly mounted to upper ram 82 such that motion of upper ram 82 relative to press table 86 parallel to axis 72 will result in corresponding relative motion of upper punch 74 to lower punch 78. Upper die 72 is mounted to upper ram 82 through the medium of a drive system 90 which may comprise a pair of hydraulic cylinders 92 mounted to upper ram 82.

Phased rotation may be accomplished by a variety of means. As illustrated in FIG. 6, upper ram 82 is further provided with a cylindrical body 94 having gearing 96. Press 80 is provided with a worm gear 98 for engagement with gearing 96. Phased rotation of upper die 72 and upper punch 74 relative to lower die 76 and lower punch 78 is then achieved by activating worm gear 98 to engage gearing 96, thereby causing cylindrical body 94, and hence upper die 72 and upper punch 74, to rotate about axis 68.

Phased lateral movement may be accomplished by a variety of means such as using an hydraulic cylinder which could be activated to move upper punch 74 and upper die 72 laterally relative to lower die 76. The method of operation of tool set 70 will now be described with the aid of FIGS. 4*a* through 4*e*. FIG. 4*a* shows tool set 70 in an open, filling position for receiving a charge of powder, indicated generally as 'A'. Lower die 76 is shown at its highest position relative to lower punch 78, and the space between them, that is to say, the space between lower die wall 98 and lower punch distal end face 100 defines a pocket, or lower chamber, 102 for receiving charge 'A'. In this open position upper die 72 and upper punch 74 are withdrawn to their highest position to permit a feed box (not shown) to move over lower chamber 102 and deposit charge 'A' therein. In a relative sense, lower punch 78 is moved far enough down within lower die 76 that lower chamber 102 can contain the entire amount of powder to form part 20 or 50, as the case may be.

After the filling of lower chamber 102 upper ram 82 is moved down until upper die 72 meets lower die 76 at an interface 104 defined by the contacting surfaces of upper die 72 and lower die 76, closing lower chamber 102. As shown in FIG. 4*b*, upper ram 82 continues to travel downward to move upper die 72 and upper punch 74. Simultaneously, lower ram 84 moves lower die 76 downward to transfer some of charge of powder 'A' from lower chamber 102 into an upper chamber 106 defined as the space between upper die 72 and upper punch 74, that is to say, within upper die wall 108 and below upper punch distal end face 110. When upper die 72 and lower die 76 are brought together to meet at interface 104 chambers 102 and 106 define between them a closed mold cavity 112. Examination of FIGS. 4*a* through 4*e* shows that the size of chambers 102 and 106, and hence cavity 112, is variable according to the relative positions of punches 74 and 78, and dies 72 and 76. More specifically, the combined size of chambers 102 and 106, and hence by definition cavity 112, in FIGS. 4*b* and 4*c* is equal to the filling size of lower chamber 102 in FIG. 4*a*. The downward relative motion of lower die 76 relative to lower punch 78 between the filling position of FIG. 4*a* and the transfer position of FIG. 4*b* results in upward motion of a portion of charge of powder 'A' relative to, and across, interface 104 to enter upper chamber 106.

The movement of powder metal into upper chamber 106, called transfer, occurs prior to phasing so that the powder metal does not have any obstruction to flow which may result in pre-densification. Although lower punch 74 is stationary in FIGS. 4*a* through 4*e*, it could also be moved to transfer the powder material into upper chamber 106.

Thereafter upper punch 74 and upper die 76 are phased relative to lower die 76 as illustrated in FIG. 4*c* to produce part 20 or 50 having undercut 34. In particular the phasing can occur by rotation of dies 72, and 76 relative to each other or by laterally displacing dies 72 and 74 relative to each other. Rotation is particularly advantageous to produce a phased part such as a cam set in the nature of part 20 as illustrated in FIGS. 1 and 2, upper die 72 being rotated relative lower die 76 by the same number of degrees to correspond to angle $\alpha$ as shown in FIG. 1.

In FIG. 4*c* the upper die and punch pair, that is upper die 72 and upper punch 74 have been phased relative to the lower die and punch pair, that is lower die 76 and lower punch 78. In other words there is lateral displacement transverse to axis 68 of one die and punch pair. The movement of the powder metal into the upper cavity, called transfer, occurs prior to phasing so that the powder metal does not have any obstruction to flow which may result in pre-densification. As also shown in FIGS. 4*b* and 4*c*, phasing occurs with chambers 102 and 106 in closed communication and with dies 72 and 76 in contact at interface 104.

FIG. 3 illustrates another part which is laterally phased.

FIG. 4 illustrates the device 17 which includes the top or upper die 1, at least one top or upper punch 2, a bottom or lower die 3, and at least one bottom or lower punch 4.

The top die 1 has a drive system 6 which may comprise a pair of hydraulic cylinders mounted to the upper ram 32 of a press 30. Accordingly, the top die is moveable relative the upper ram by means of the drive system 6. The top punch 2 is mounted on the upper ram 32 in a manner which shall be more precisely described below while the bottom die 3 is mounted to the lower ram 34 of the press 30.

The upper punch 2 is associated with the upper die 1. In particular, the upper die 1 has a hole 8 for receiving upper punch 2 for slidable relative motion therebetween.

The lower punch 4 is mounted for relative linear slidable movement with the lower die 3. In particular, lower die 3 includes a hole 9 to receive punches 4 for relative slidable movement therebetween.

The upper die 1 and lower die 3 are adapted for linear relative movement between an open position as illustrated in FIG. 4*a* and a closed position as shown in FIG. 4*b*. In the open position, a feed box (not shown) moves over the cavity 7. The cavity 7 is defined by the space between the lower die 3 and the lower punch 4 when the lower punch 4 is in its lowest position relative the lower die 3. The lower punch 4 is moved far enough down or in its lowest position that enough powder 12 can be stored for the compaction of the part 13.

After filling of the cavity 7 the upper ram 32 is moved down until the upper die 1 is touching the lower die 3 as shown in FIG. 4*b* for sealing of the cavity 7. As shown in FIG. 4*b*, the upper ram continues to travel downward so as to move the upper die and the upper punch. Simultaneously, the lower ram moves the lower die downward so as to transfer the powder 12 from the lower cavity 7 into the upper cavity 14 in the top die 1. In other words we have movement between the upper punch, upper die and lower die relative the lower punch. The movement of the powder metal into the upper cavity occurs prior to phasing so that the powder metal does not have any obstruction to flow which may result in pre-densification. The upper cavity 14 is defined by the upper die 1 and upper punch 2.

Although the lower punch 4 is stationary in FIG. 4, the lower punch 4 could also be moved to transfer the powder material into the upper cavity 14.

Thereafter the upper punch and upper die is phased relative the lower die as illustrated in FIG. 3*c* so as to produce a part 13 having an undercut 15. In particular the phasing can occur by rotation of the dies 1, and 3 relative each other or by laterally displacing the dies. Rotation is particularly advantageous so as to produce a phased part such as the camset 2 illustrated in FIGS. 1 and 2. Moreover, the upper die would be rotated relative the lower die by the same number of degrees so as to correspond to the angle as shown in FIG. 1.

Phased rotation may be accomplished by a variety of means such as, for example, utilizing a worm gear 60 which could be activated so as to engage gears 62 and thereby cause the cylindrical body 64 to rotate about axis 66. The cylindrical body 64 is mounted to the ram 32 and the upper punch 2 and upper die 1 is mounted to the body 64.

Phased lateral movement may be accomplished by a variety of means such as utilizing an hydraulic cylinder which could be activated to move upper punch 74 and upper die 72 laterally relative to lower die 78, that is, transverse to, or in a plane normal to, vertical axis 68.

The compaction step is then shown in FIG. 4*d* and is accomplished by moving upper ram 82 and both dies 72 and 76 and upper punch 74 with a suitable speed relationship. After compaction the part indicated generally as B' is ejected by withdrawing upper die 72 upward and lower die 76 downward as shown in the ejection position FIG. 4*e* in which upper die 72 and lower die 76 have been separated at interface 104 and withdrawn, upper die 72 withdrawn flush with upper punch 74 and lower die 76 withdrawn flush with lower punch 78 to expose part 'B'. Compaction occurs after phasing. As shown in FIGS. 4*a* to 4*e*, respectively, tool set 70, and hence a press assembly including press 80 of FIG. 6 and tool set 70, is movable to filling, transfer, transverse displacement, compaction and withdrawal positions. Upper die 72 is illustrated mounted in at least partial engagement of upper punch 74, and Lower die 76 is illustrated mounted in at least partial engagement of lower punch 78 throughout FIGS. 4*a* to 4*e*.

The embodiment illustrated in FIGS. 4*a* through 4*e* shows the compaction of a single level part 20 or 50 with an undercut 34. The invention is not limited thereto but can also be used for multilevel parts with an undercut by introducing necessary additional top and bottom punches. For example, FIG. 5 illustrates a tool set 120 for producing a part having multiple levels by utilizing several punches. Those illustrated in tool set 120 of FIG. 5 include a core rod 122; an inner lower, or hub punch 124, disposed about core rod 122; an intermediate lower, or lower web punch 126, disposed about hub punch 124; and an outer lower, lower flange, or lower crown punch 128, disposed about lower web punch 126 and contained within a lower die 130. Corresponding upper die and punch components are shown as an upper, upper web or upper inner punch 132 having an aperture 134 for admitting core rod 122; an upper outer, upper flange, or upper crown punch 136; and an upper die 138. Upper inner punch 132, upper crown punch 136 and upper die 138 are nested in a manner similar to that described for lower members of tool set 120. Numeral 140 shows the pitch diameter of the tooth form within the punches and respective dies. Rotationally phasing upper die 138 relative to lower die 130 according to he method of the present invention through a phase angle a will result in $\alpha$ part having upper and lower gear profiles having teeth offset by that angle.

In order to conduct all necessary movements during the cycle with suitable precision, speeds and timing, an hydraulic press with closed loop controls is preferably used, although the invention is not limited thereto.

The drawings illustrate the withdrawal principal which means that after compaction the lower die is withdrawn to eject the part. However the invention described herein is also applicable for the counterpressing principle in which case the bottom, or lower, die is stationary relative to the press and all the bottom, or lower punches are mounted to the lower ram (including the drives for achieving relative movements between the bottom punches, if more than one bottom punch), so that after compaction the bottom punches will be moved further through the bottom die by the lower ram in order to eject the part.

Although the preferred embodiment and its the operation and use have been specifically described in relation to the drawings, it should be understood that variations from the preferred embodiment could be achieved by a person skilled in the art without departing from the spirit of the invention as claimed herein.

What is claimed is:

1. A method of forming from a powdered metal charge a phased component having upper and lower portions of similar shape but displaced relative to one another, said method comprising the steps of: providing an upper die set and a lower die set wherein at least one die set comprises a punch and a die, forming a cavity in each of said die sets corresponding to respective ones of said shapes, bringing said die sets into abutment along a plane of separation with said cavities substantially aligned to form a mold cavity, moving one of said dies relative to the other die in said plane of separation to phase said dies prior to compression of said charge, subsequently compressing said charge within said mold cavity to form said phased component, separating said dies at said plane of separation, and removing said component.

2. A method according to claim 1 wherein said dies are rotated relative to one another prior to compression of said charge.

3. A method according to claim 1 wherein said dies are displaced laterally in said plane of separation prior to compression.

4. A method according to claim 1 wherein each of said die sets includes a punch moveable relative to its respective die to compress said charge.

5. A method according to claim 1 wherein said charge is placed in a cavity of one of said die sets prior to said dies being brought into abutment.

6. A method according to claim 5 wherein a portion of said charge is transferred between said cavities after abutment of said dies and prior to relative displacement thereof.

7. A method according to claim 6 wherein each of said die sets includes a punch moveable relative to its respective die and said punch associated with of said one of said die sets is operable to transfer said portion of said charge between said cavities.

8. A method according to claim 7 wherein said dies are rotated relative to one another prior to compaction.

* * * * *